US007622857B2

(12) United States Patent
Yoo et al.

(10) Patent No.: US 7,622,857 B2
(45) Date of Patent: Nov. 24, 2009

(54) ELECTRON EMISSION DISPLAY

(75) Inventors: Seung Joon Yoo, Suwon (KR); Jong Sick Choi, Suwon (KR); Zin Min Park, Cheonan (KR); Soo Joung Lee, Anyang (KR); Jung Ho Kang, Yongin (KR); Su Kyung Lee, Cheonan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 651 days.

(21) Appl. No.: 11/264,739

(22) Filed: Oct. 31, 2005

(65) Prior Publication Data

US 2006/0113890 A1 Jun. 1, 2006

(30) Foreign Application Priority Data

Oct. 29, 2004 (KR) ..... 10-2004-0087520

(51) Int. Cl.
*H01J 1/62* (2006.01)
*H01J 63/04* (2006.01)

(52) U.S. Cl. ..... 313/496; 313/495; 445/24

(58) Field of Classification Search ..... 313/495–497; 445/24

See application file for complete search history.

(56) References Cited

U.S. PATENT DOCUMENTS 5,477,105 A * 12/1995 Curtin et al. ..... 313/422
2003/0141806 A1* 7/2003 Hofmann et al. ..... 313/497

FOREIGN PATENT DOCUMENTS

KR 1999-002071 A 1/1999
KR 10-2004-0069579 8/2004
KR 10-2004-0069581 8/2004

OTHER PUBLICATIONS

Korean Patent Abstracts, Publication No. 100241155 B1; Date of publication of specification: Nov. 2, 1999.

* cited by examiner

*Primary Examiner*—Nimeshkumar D. Patel
*Assistant Examiner*—Anthony T Perry
(74) *Attorney, Agent, or Firm*—Christie, Parker & Hale, LLP

(57) ABSTRACT

An electron emission display including a first substrate having at least one electron emission device and a second substrate opposite the first substrate. The second substrate is formed with an effective region and a non-effective region. The effective region includes a fluorescent layer for emitting light by collision with electrons emitted from the electron emission device. The non-effective region includes a region in which a light-shielding layer has a transparent conductive layer and a metal layer. The transparent conductive layer is formed in the effective region where the fluorescent layer is absent. The second substrate improves the brightness of light emitted from the fluorescent layer and prevents a power supply layer, to which a high voltage is applied, from being damaged, because the transparent conductive layer is not formed under the effective region.

20 Claims, 12 Drawing Sheets

ELECTRON EMISSION DISPLAY

CROSS-REFERENCE TO RELATED APPLICATIONS

This application claims priority to and the benefit of Korean Patent Application No. 10-2004-0087520, filed Oct. 29, 2004, the disclosure of which is hereby incorporated herein by reference in its entirety.

BACKGROUND

1. Field of the Invention

The present invention relates to an electron emission display and, more particularly, to an electron emission display capable of improving luminous efficiency by not forming a transparent conductive layer under an effective region including a fluorescent layer.

2. Discussion of Related Art

In general, an electron emission device uses a hot cathode or a cold cathode as an electron source. An electron emission device using the cold cathode may employ a field emitter array (FEA) type device, a surface conduction emitter (SCE) type device, a metal-insulator-metal (MIM) type device, a metal-insulator-semiconductor (MIS) type device or a ballistic electron surface emitting (BSE) type device.

Using these electron emission devices, an electron emission display that further includes various types of backlights, an electron beam apparatus for lithography and other components can be implemented. The electron emission display includes an electron emission part on a first substrate and an image forming part on a second substrate opposite the electron emission part.

The electron emission part includes a bottom substrate, an electron emission device formed on the bottom substrate, a cathode electrode and a gate electrode configured in a matrix shape on the bottom substrate. The electron emission device emits electrons.

The image forming part includes a top substrate, a fluorescent material formed on the top substrate and an anode electrode electrically connected to the fluorescent material. The electrons emitted from the electron emission part collide with the fluorescent material to generate light.

In addition, the image forming part further includes a light-shielding layer for absorbing or shielding external light and preventing optical crosstalk. An example of a method of fabricating the light-shielding layer is disclosed in Korean Laid-open Publication No. 1999-2071.

A conventional method of fabricating a light-shielding layer will be described in conjunction with the accompanying drawings. FIGS. 1A to 1D are cross-sectional views illustrating a manufacturing process for an image forming part having a light-shielding layer formed thereon according to the prior art. Referring to FIGS. 1A to 1D, a method of fabricating the light-shielding layer, according to the prior art, includes forming an anode electrode 120 on a top substrate 110 and forming a light-shielding layer 150 on the anode electrode 120.

First, referring to FIG. 1A, the anode electrode 120 is formed on the top substrate 110. The anode electrode 120 may be referred to as an ITO electrode since it is made of indium tin oxide (ITO). Next, referring to FIG. 1B, fluorescent layers 130 are formed on the anode electrode 120. The fluorescent layers 130 are formed separately from each other using a slurry method. While the fluorescent layer is formed by the slurry method, the fluorescent layer is formed using a screen printing method, an electrophoresis method, or a transfer method.

Next, a metal material, for example, Cr, is deposited and line-patterned between the separately formed fluorescent layers 130, see FIG. 1C. Then, the Cr 140 formed between the fluorescent layers 130 and the anode electrode 120 made of ITO causes an oxidation reaction to form black CrOx. The oxidized black CrOx becomes a light-shielding layer 150 for absorbing or shielding external light, see FIG. 1D. As described above, the light-shielding layer 150 may be made by the reaction of ITO and Cr or a pattern printing method using black Fodel or Ag Fodel. A power supply layer (not shown) for applying a voltage to the anode electrode 120 from an external power source is formed to be electrically connected to the light-shielding layer 150. The power supply layer is made of an ITO electrode and Cr.

The fluorescent layer 130 is formed on the ITO electrode 120 that is applied to the top substrate 110. As a result, because the light generated by the collision of the electrons emitted from the electron emission device and the fluorescent layer is emitted to the exterior through the ITO electrode, the brightness of the generated light may be lowered in proportion to the thickness of the ITO electrode. In addition, because the power supply layer is made of the ITO electrode and Cr, the Cr layer is likely to corrode due to high voltage applied from the exterior.

SUMMARY

The embodiments of the present invention provide an electron emission display having a structure that allows light generated from a fluorescent layer to be directly emitted to the exterior of the display without passing through a transparent conductive layer (ITO electrode).

The embodiments of the present invention also provide an electron emission display having a power supply layer made of a transparent conductive layer formed on an effective region with an outer portion of a non-effective region being electrically connected thereto.

In one exemplary embodiment of the present invention, an electron emission display includes a first substrate having at least one electron emission device and a second substrate opposite to the first substrate. A surface of the second substrate facing the first substrate is formed with an effective region and a non-effective region. The effective region includes a fluorescent layer for emitting light by a collision with electrons emitted from the electron emission device. The non-effective region includes a light-shielding layer having a transparent conductive layer and a metal layer. The transparent conductive layer is formed in a region between the fluorescent layers of the effective region. A metal layer is formed on the effective region and the non-effective region. In addition, a power supply layer is formed to be electrically connected to the transparent conductive layer and to receive a power source from the exterior.

The transparent conductive layer may be made of one of ITO and indium zinc oxide (IZO). The metal layer may be made of Cr. The electron emission display may further include a metal layer formed on the fluorescent layer and the light-shielding layer. The metal layer may be made of aluminum. The light-shielding layer may be formed in a stripe pattern or matrix pattern. The power supply layer may be made of one of ITO and IZO. The power supply layer may be integrally formed with the transparent conductive layer.

DETAILED DESCRIPTION

Figure 1A:
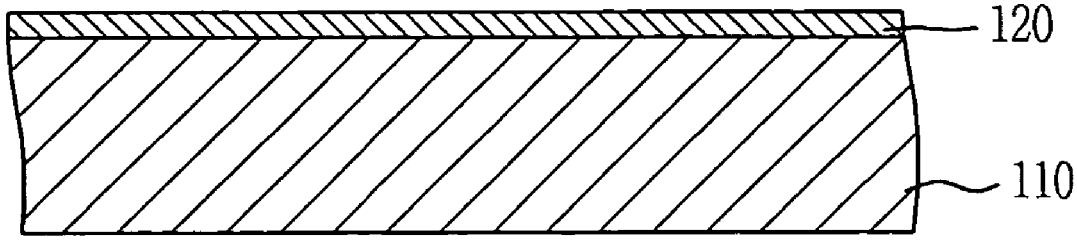
FIG. 1A (PRIOR ART)
FIG. 1A is a cross-sectional view illustrating a method of fabricating an image forming substrate of an electron emission display according to prior art.
Figure 1B:
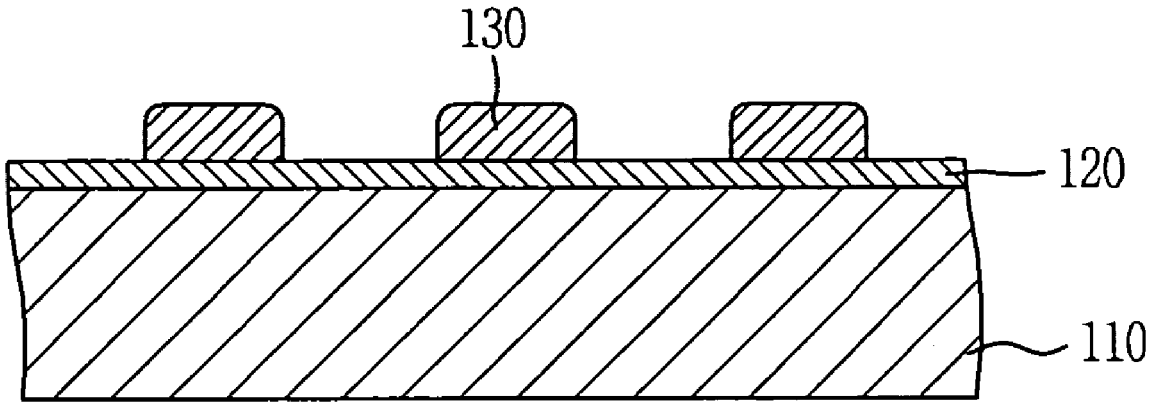
FIG. 1B (PRIOR ART)
FIG. 1B is a cross-sectional view illustrating a method of fabricating an image forming substrate of an electron emission display according to prior art.
Figure 1C:
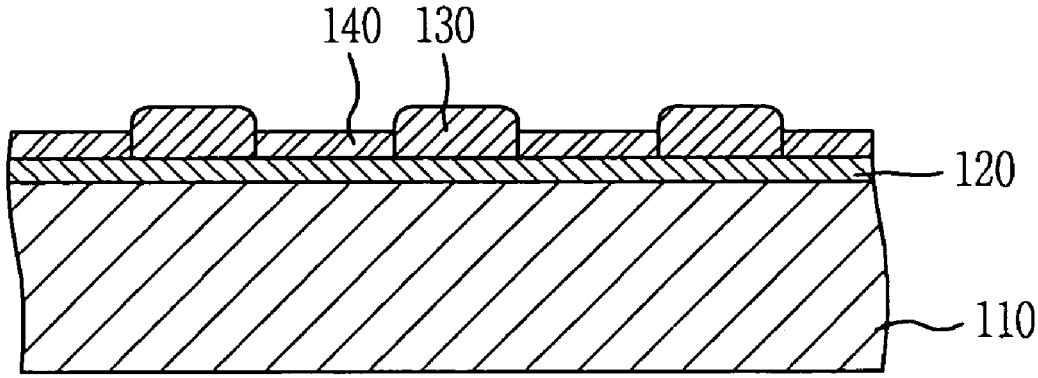
FIG. 1C (PRIOR ART)
FIG. 1C is a cross-sectional view illustrating a method of fabricating an image forming substrate of an electron emission display according to prior art.
Figure 1D:
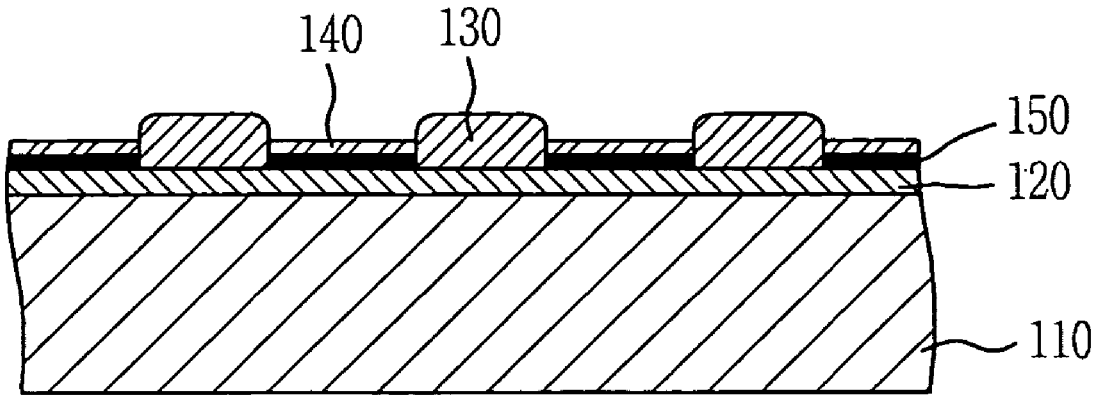
FIG. 1D (PRIOR ART)
FIG. 1D is a cross-sectional view illustrating a method of fabricating an image forming substrate of an electron emission display according to prior art.
Figure 2:
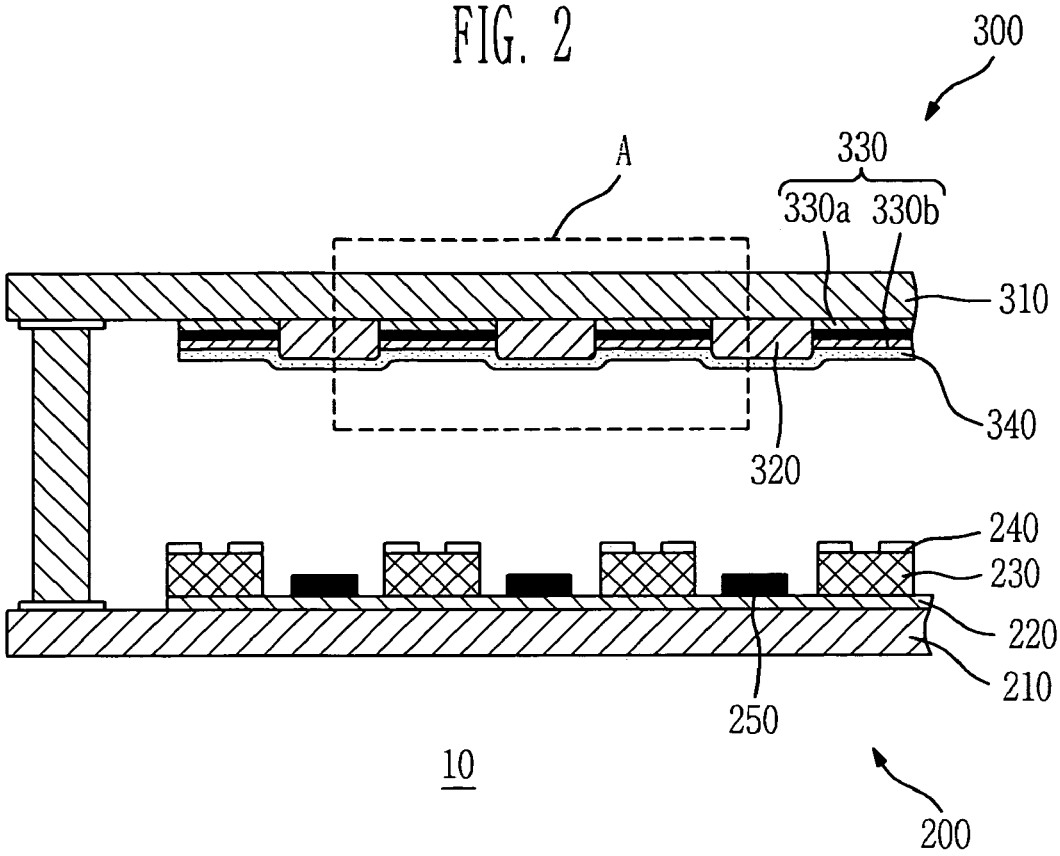
FIG. 2 is a schematic side cross-sectional view of an electron emission display according to an embodiment of the present invention.

Referring to FIG. 2, the electron emission display 10 of the present invention includes a first substrate 200, an electron emission substrate, having an electron emission device 250 formed therein and a second substrate 300, an image forming substrate, disposed opposite to the electron emission substrate 200. The second substrate 300 includes an effective region and a non-effective region. The effective region has a fluorescent layer 320 for emitting light in response to electrons emitted from the electron emission device 250.

Referring to FIG. 2, the first substrate, i.e., the electron emission substrate 200, includes a bottom substrate 210, a cathode electrode 220 formed on the bottom substrate 210 in a predetermined shape, for example, a stripe shape, and a gate electrode 240 insulated and spaced apart from the cathode electrode in an intersected manner. An insulating layer 230 is formed between the cathode electrode 220 and the gate electrode 240 to electrically insulate the cathode electrode 220 from the gate electrode 240. An electron emission device 250 is formed on the bottom substrate 210. The electron emission device 250 is formed in each region in which the cathode electrode 220 and the gate electrode 240 intersect each other. The pattern of intersections may be in a matrix shape.

The bottom substrate 210 is generally made of a glass or silicon. In one embodiment, a transparent substrate such as a glass substrate is used when a rear surface of the electron emission device 250 is exposed using carbon nanotube (CNT) paste. The cathode electrode 220 and the intersecting gate electrode 240 transmit each data signal or scan signal supplied from a data driving part or a scan driving part (not shown) to each electron emission device 250, thereby driving the appropriate electron emission device 250 in a matrix of electron emission devices. An electric field is created around the electron emission device 250 by the driving signal. As a result, electrons are emitted from the electron emission device 250.

Figure 3:
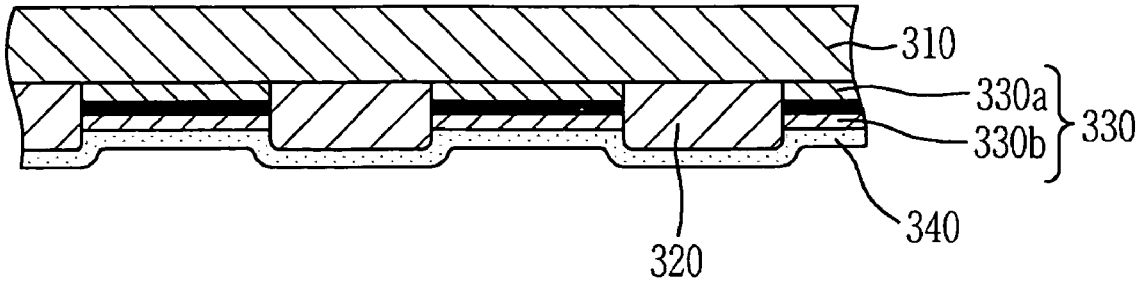
FIG. 3 is a partially enlarged cross-sectional view of the image forming substrate separated from FIG. 2.
Figure 4:
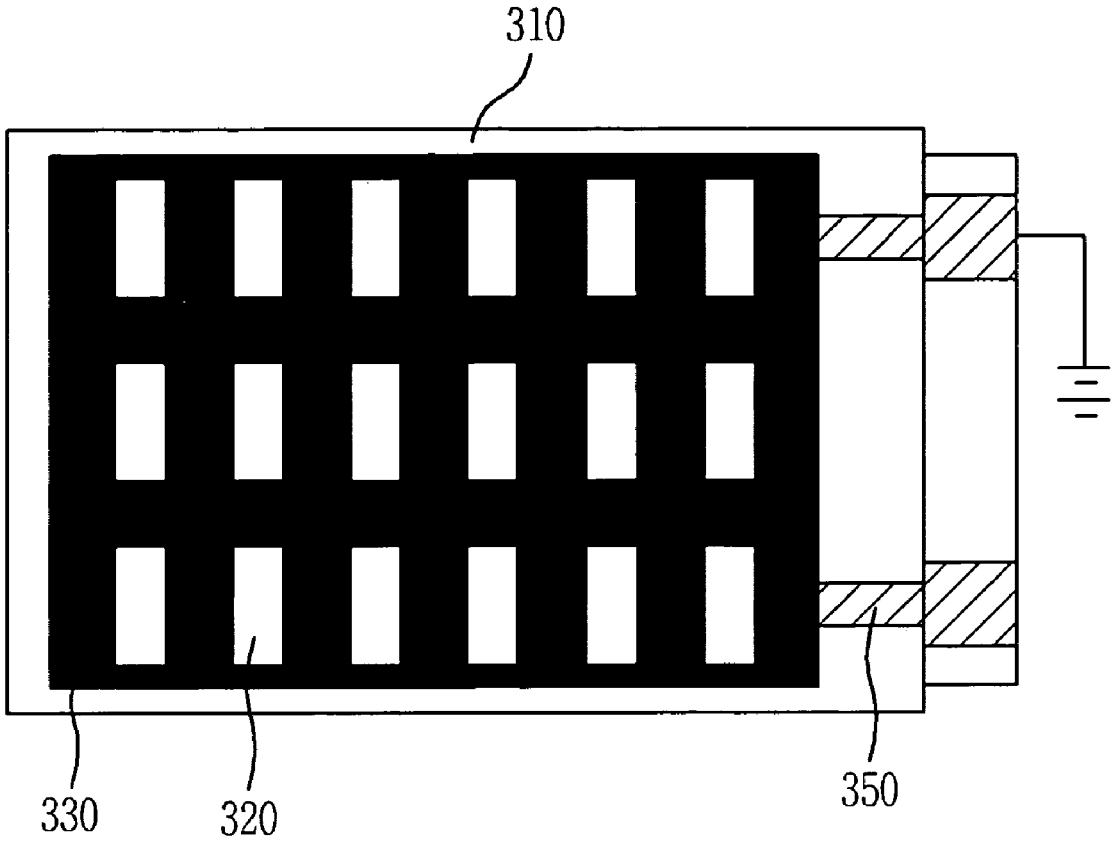
FIG. 4 is a plan view of an image forming substrate according to one embodiment of the present invention.

Referring to FIGS. 2 to 4, the image forming substrate 300, i.e., the second substrate, is disposed opposite to the electron emission substrate 200. The image forming substrate 300 includes a top substrate 310. The top substrate 310 may be made of a transparent material. An effective region and a non-effective region are separately formed on the top surface 310. A metal layer 340 is formed on the effective region and the non-effective region.

The effective region includes a fluorescent layer 320, which is a region capable of emitting light by the collision with the electrons emitted from the electron emission device 250. The non-effective region is a region capable of absorbing or shielding external light and preventing optical crosstalk to improve the contrast. Hereinafter, the effective region and the non-effective region will be referred to as a fluorescent layer 320 and a light-shielding layer 330, respectively, for sake of convenience and clarity.

The fluorescent layer 320 may be disposed in a stripe shape, matrix shape or other shape or pattern. The fluorescent layers 320 are selectively disposed on the top substrate 310 at an arbitrary interval to emit light by means of the collision with the electrons emitted from the electron emission device 250.

The light-shielding layer 330 is formed by depositing a transparent conductive layer 330*a* and a metal layer 330*b* between the fluorescent layers 320. The transparent conductive layer 330*a* may be made of ITO or IZO. The transparent conductive layer 330*a* may be formed in a stripe shape or matrix shape corresponding to or complementing the shape of the fluorescent layer 320. The metal layer 330*b* is sputtered and line-patterned on the transparent conductive layer 330*a*. The metal layer 330*b* is formed of chromium (Cr). Chromium Oxide (CrOx) is formed by the reaction of the transparent conductive layer 330*a* and the metal layer 330*b*, i.e., ITO and Cr, and functions as the light-shielding layer 330 between the fluorescent layers 320. The light-shielding layer 330 formed by the oxidation of the transparent conductive layer 330*a* and the metal layer 330*b* is capable of absorbing and shielding external light and preventing optical crosstalk, thereby improving contrast.

A metal layer 340 is electrically connected to the fluorescent layer 320. The metal layer 340 is disposed on the fluorescent layer 320 and the light-shielding layer 330. The metal layer 340 functions as an electrode for accelerating the electrons emitted from the electron emission device 250 toward the fluorescent layer 320. The metal layer 340 is electrically connected to the fluorescent layer 320 to more favorably collect the electrons emitted from the electron emission device 250 and to reflect the light generated by the collision of the electrons with the top substrate 310, thereby improving reflection efficiency. In one embodiment, the metal layer 340 is made of aluminum (Al).

A power supply layer 350 is formed on at least one side of the light-shielding layer 330 to be electrically connected to the transparent conductive layer 330*a*. The power supply layer 350 may receive power from an external power source. The power supply layer 350 is integrally or separately formed with or from the transparent conductive layer 330*a* to be electrically connected to the transparent conductive layer 330*a*. The power supply layer 350 is formed of ITO, which is the same material as the transparent conductive layer 330*a*. A predetermined sealing process is performed using a sealant (not shown) to create a vacuum in a space between the electron emission substrate 200 and the image forming substrate 300.

FIGS. 5A to 5E are cross-sectional views illustrating one embodiment of a method of fabricating an image forming substrate. One embodiment of a method of fabricating the image forming substrate includes directly forming fluorescent layers 320 on a top substrate 310. The method also includes forming a non-effective region having a light-shielding layer 330, a transparent conductive layer 330*a* and a metal layer 330*b* between the fluorescent layers 320. The method further includes forming a power supply layer 350 electrically connected to the transparent conductive layer 330*a* in a region of the light-shielding layer 330.

Figure 5A:
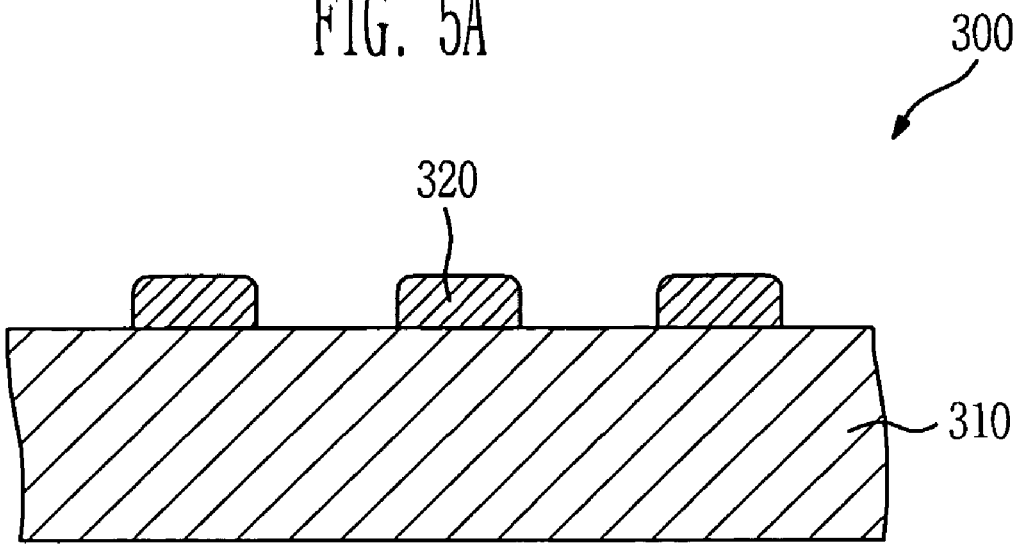
FIG. 5A is a partial cross-sectional view illustrating a method of fabricating an image forming substrate according to one embodiment of the present invention.

Referring to FIGS. 5A to 5E, to manufacture the image forming substrate 300, the top substrate 310 is prepared and the fluorescent layers 320 are separately formed on the top substrate 310, see FIG. 5A. The fluorescent layer 320 is generally composed of a red fluorescent material (R), a green fluorescent material (G), and a blue fluorescent material (B). The fluorescent materials used in the respective fluorescent layers may be any type of fluorescent materials used in conventional electron emission displays. The fluorescent layers 320 are separately formed on the top substrate 310 using a slurry method. In another embodiment, the fluorescent layers may be formed by a screen-printing method, an electrophoresis method, or a transfer method.

Figure 5B:
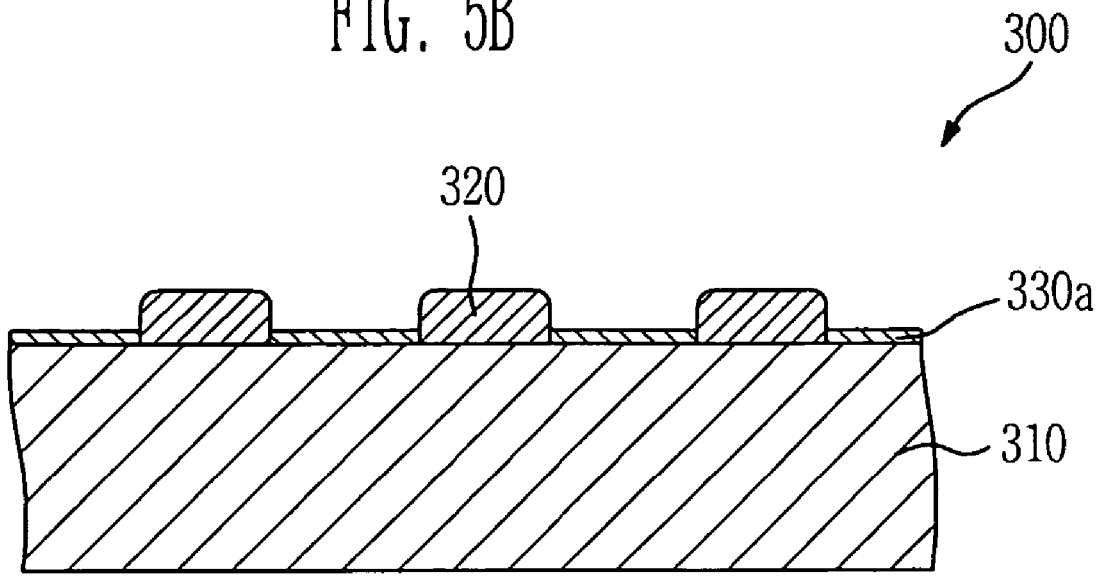
FIG. 5B is a partial cross-sectional view illustrating a method of fabricating an image forming substrate according to one embodiment of the present invention.
Figure 5C:
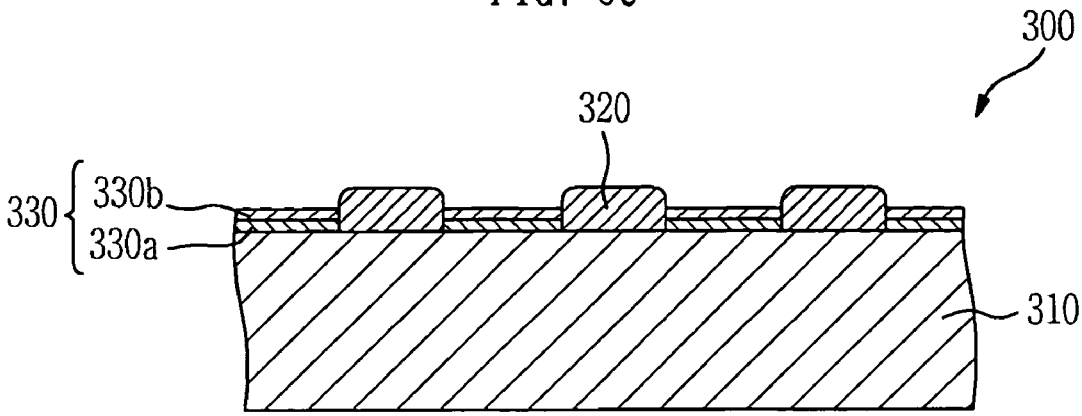
FIG. 5C is a partial cross-sectional view illustrating a method of fabricating an image forming substrate according to one embodiment of the present invention.
Figure 5D:
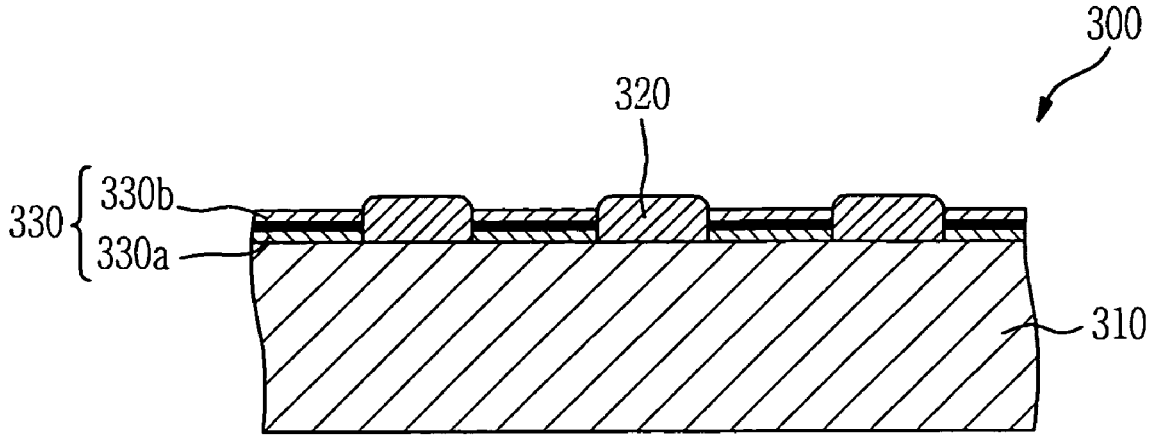
FIG. 5D is a partial cross-sectional view illustrating a method of fabricating an image forming substrate according to one embodiment of the present invention.
Figure 5E:
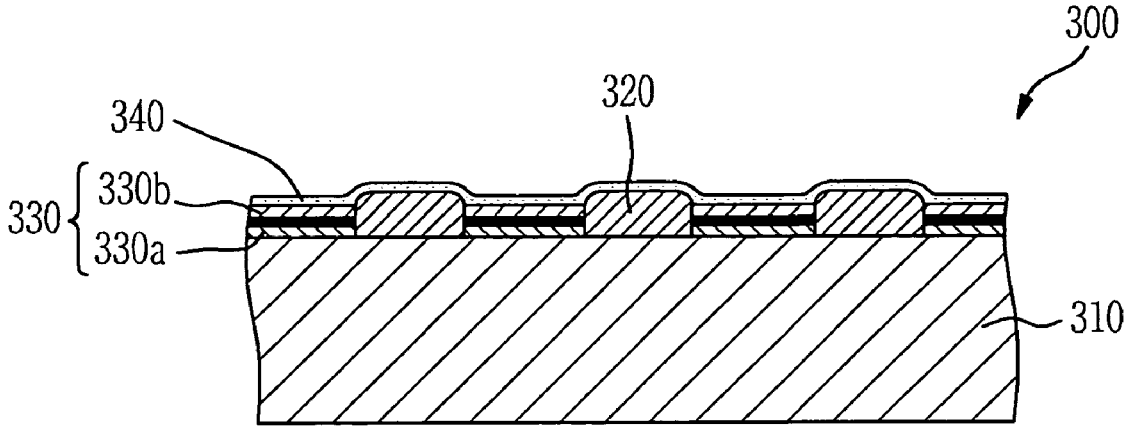
FIG. 5E is a partial cross-sectional view illustrating a method of fabricating an image forming substrate according to one embodiment of the present invention.

Referring to FIGS. 5B and 5C, a transparent conductive layer 330*a* is formed on the top substrate 310 between the fluorescent layers 320, and a metal layer 330*b* is formed on the transparent conductive layer 330*a*. The transparent conductive layer 330*a* is made of ITO, and the metal layer is made of Cr. Referring to FIG. 5D, ITO and Cr cause an oxidation reaction to form black CrOx between the fluorescent layers, and the black CrOx functions as the light-shielding layer. A metal layer 340 is formed on the fluorescent layers 320 and the light-shielding layer 330. The metal layer 340 is made of aluminum.

To supply the external power source to the fluorescent layers 320, the method may include forming a power supply layer 350 on one side of the light-shielding layer 330 that is electrically connected to the light-shielding layer 330. The power supply layer 350 is formed of ITO.

The embodiments described herein illustrate examples where the transparent conductive layer is not formed under the fluorescent layers that constitute the effective region. The transparent conductive layer may be deposited on a predetermined region between the fluorescent layers that constitute the effective region when the effective region is configured in a stripe shape. In addition, while the embodiments describe a structure where the power supply layer is electrically connected to the light-shielding layer, the power supply layer may be separately formed to be connected to the transparent conductive layer. The power supply layer may be integrally formed with the transparent conductive layer on the substrate.

The electron emission display in the embodiments of the present invention is capable of increasing luminous efficiency because the transparent conductive layer is not formed under the fluorescent layers thereby allowing the light emitted from the fluorescent layers to be transmitted with a high efficiency. In addition, because the power supply layer is made of ITO and electrically connected to the non-effective region, it is possible to prevent the power supply layer from being damaged due to high voltage.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An electron emission display comprising:

a first substrate having at least one electron emission device;

a second substrate opposite to the first substrate;

a fluorescent layer directly on a surface of the second substrate facing the first substrate for emitting light by a collision with electrons emitted from the electron emission device; and a light-shielding layer having a transparent conductive layer and a first metal layer, wherein the transparent conductive layer is directly on said surface of the second substrate in a space defined by the fluorescent layer.

2. The electron emission display according to claim 1, further comprising:

a second metal layer on the fluorescent layer and the light-shielding layer.

3. The electron emission display according to claim 1, further comprising:

a power supply layer on at least one side of the transparent conductive layer and electrically connected to the transparent conductive layer, the power supply layer to receive exterior power.

4. The electron emission display according to claim 1, wherein the transparent conductive layer includes one of indium tin oxide (ITO) and indium zinc oxide (IZO).

5. The electron emission display according to claim 1, wherein the first metal layer is chromium.

6. The electron emission display according to claim 2, wherein the second metal layer is aluminum.

7. The electron emission display according to claim 1, wherein the fluorescent layer is one of a stripe shape or matrix shape.

8. The electron emission display according to claim 1, wherein the transparent conductive layer is a stripe shape or matrix shape.

9. The electron emission display according to claim 3, wherein the power supply layer is one of indium tin oxide and indium zinc oxide.

10. The electron emission display according to claim 3, wherein the power supply layer is integral with the transparent conductive layer.

11. A device comprising:

a substrate;

a plurality of fluorescent regions directly on the substrate; and a light shielding layer including a transparent conductive layer and a first metal layer, said transparent conductive layer being directly on the substrate in space defined by the plurality of fluorescent regions and the first metal layer formed on the transparent conductive layer.

12. The device of claim 11, further comprising:

a second metal layer on the fluorescent layer and the light-shielding layer.

13. The device of claim 11, wherein the transparent conductive layer includes one of indium tin oxide (ITO) and indium zinc oxide (IZO).

14. The device of claim 11, wherein the first metal layer is chromium.

15. The device of claim 11, wherein the light shielding layer includes chromium oxide.

16. A method comprising:

forming a substrate;

patterning a fluorescent layer directly on the substrate;

forming a transparent conducting layer directly on the substrate in a space defined by the fluorescent layer; and forming a first metal layer on the transparent conducting layer, the first metal layer for reacting with the transparent conducting layer to form a light shielding layer.

17. The method of claim 16, further comprising:

forming a second metal layer on the fluorescent layer and the first metal layer.

18. The method of claim 16, wherein the fluorescent layer is one of a stripe shape or matrix shape.

19. The method of claim 16, wherein the transparent conductive layer is in a stripe shape or matrix shape.

20. The method of claim 16, wherein the first metal layer is chromium.

* * * * *